US011572771B2

(12) United States Patent
Talton, III et al.

(10) Patent No.: US 11,572,771 B2
(45) Date of Patent: Feb. 7, 2023

(54) AUTOMATED METHOD FOR GAS LIFT OPERATIONS

(71) Applicant: Flogistix, LP, Oklahoma City, OK (US)

(72) Inventors: Brooks Mims Talton, III, Oklahoma City, OK (US); Aaron Baker, Pampa, TX (US); Eric Perry, Pampa, TX (US); Paul Munding, Oklahoma City, OK (US); John D. Hudson, Oklahoma City, OK (US)

(73) Assignee: Flogistix, LP, Oklahoma City, OK (US)

( * ) Notice: Subject to any disclaimer, the term of this patent is extended or adjusted under 35 U.S.C. 154(b) by 0 days.

(21) Appl. No.: 17/636,588

(22) PCT Filed: Aug. 19, 2020

(86) PCT No.: PCT/US2020/047014
§ 371 (c)(1),
(2) Date: Feb. 18, 2022

(87) PCT Pub. No.: WO2020/252494
PCT Pub. Date: Dec. 17, 2020

(65) Prior Publication Data

US 2022/0268137 A1 Aug. 25, 2022

Related U.S. Application Data

(60) Provisional application No. 62/893,976, filed on Aug. 30, 2019.

(51) Int. Cl.
*E21B 43/12* (2006.01)
*E21B 47/06* (2012.01)

(52) U.S. Cl.
CPC ..... *E21B 43/122* (2013.01); *E21B 47/06* (2013.01)

(58) Field of Classification Search
CPC ..... E21B 43/122; E21B 21/08; E21B 47/06
See application file for complete search history.

(56) References Cited

U.S. PATENT DOCUMENTS

| | | | |
|---|---|---|---|
| 5,871,048 | A | 2/1999 | Tokar et al. |
| 8,028,754 | B2 | 10/2011 | Daniels et al. |
| 9,951,601 | B2 | 4/2018 | Rashid et al. |
| 10,443,358 | B2 | 10/2019 | Rashid et al. |
| 2002/0074118 | A1 | 6/2002 | Fisher |
| 2009/0266554 | A1 | 10/2009 | Wilson et al. |

(Continued)

OTHER PUBLICATIONS

PCT International Search Report & Written Opinion mailed in corresponding PCT Application No. PCT/US2020/047014 dated Oct. 27, 2020, pp. 1-11.

(Continued)

*Primary Examiner* — Brad Harcourt
(74) *Attorney, Agent, or Firm* — McAfee & Taft

(57) ABSTRACT

Disclosed is a compressor system suitable for carrying out artificial gas lift operations at an oil or gas well. Also disclosed is a method for controlling the compressor system. The methods disclosed provide the well operator with the ability to identify and maintain gas injection rates which result in the minimum production pressure. The minimum production pressure will be determined either by a bottom hole sensor or a casing pressure sensor located at the surface or any convenient location capable of monitoring pressure at the wellhead.

22 Claims, 13 Drawing Sheets

(56) References Cited

U.S. PATENT DOCUMENTS

| | | | | |
|---|---|---|---|---|
| 2010/0042458 | A1* | 2/2010 | Rashid | G06Q 10/04 703/10 |
| 2012/0215364 | A1* | 8/2012 | Rossi | E21B 43/121 700/281 |
| 2016/0053753 | A1 | 2/2016 | Rashid et al. | |
| 2017/0051588 | A1 | 2/2017 | Elmer | |
| 2017/0356278 | A1 | 12/2017 | Nandola et al. | |
| 2018/0087349 | A1 | 3/2018 | Mills | |
| 2018/0179869 | A1 | 6/2018 | Moffett et al. | |
| 2021/0148200 | A1* | 5/2021 | Bridges | E21B 43/122 |

OTHER PUBLICATIONS

US Environmental Protection Agency, Lessons Learned from Natural Gas Star Partners, 2011, pp. 1-18.

Bolujo, E.O., et al., A New Model for Predicting Liquid Loading in Multiphase Gas Wells, vol. 12, No. 14, 2017, pp. 4578-4586.

Guo, Boyun, et al., A Systematic Approach to Predicting Liquid Loading in Gas Wells, SPE Productions & Operations, Feb. 2006, pp. 80-88.

Hagedorn, Alton R., et al., Experimental Study of Pressure Gradients Occurring During Continuous Two-Phase Flow in Small-Diameter Vertical Conduits, Journal of Petroleum Technology, Apr. 1965, pp. 475-484.

Tuzovskiy, Mikhail, Hagedorn and Brown Correlation Overview, 2017, pp. 1-13.

* cited by examiner

Guo Equations $$144ba_1 + \frac{1-2bm}{2}\ln a_2 - \frac{m + \frac{b}{c}n - bm^2}{\sqrt{n}}\left[\tan^{-1}\beta_1 - \tan^{-1}\beta_2\right] = \gamma \quad (1)$$

Where:

$$a_1 = 9.3\,x\,10^{-5}\,\frac{S_g\,Tbh\,Q_{gm}}{A_1^2 E_{km}} - p_{hf} \quad (2)$$

$$a_2 = \frac{\left(1.34\,x\,10^{-2}\,\frac{S_g T_{bh} Q_{gm}}{A_1^2 E_{km}} + m\right)2 + n}{(144p_{hf} + m)2 + n} \quad (3)$$

$$\beta_1 = \frac{\left(1.34\,x\,10^{-2}\,\frac{S_g T_{bh} Q_{gm}}{A_1^2 E_{km}} + m\right)}{\sqrt{n}} \quad (4)$$

$$\beta_2 = \frac{144\rho_{hf} + m}{\sqrt{n}} \quad (5)$$

$$\gamma = \alpha(1 + d^2 e)L \quad (6)$$

Where:

$S_g$ = Specific gravity of gas, air =1

$T_{bh}$ = Temperature at bottom hole $Q_{gm}$ = Minimum air/gas injection rate required to carry liquid droplets, scf/min $A_i$ = Cross sectional area of annulus, $in^2$ $E_{km}$ = Minimum kinetic energy required to carry liquid droplets, $lb_f - ft/ft^3$ $P_{hf}$ = Bottomhole pressure, psi $a, b, c, d, e, m, n, \alpha_1, \alpha_2, \beta_1, \beta_2, \gamma$ = Guo Critical Rate Model quantities $L$ = Pipe length, ft

FIG. 6A

Guo Equations cont.

$$a = \frac{15.33 S_g Q_g + 86.07 S_W Q_W + 86.07 S_O Q_O + 18.79 S_g Q_G}{10^3 T_{av} Q_G} \cos(\theta) \quad (7)$$

$$b = \frac{0.2456 Q_S + 1.379 Q_W + 1.379 Q_o}{10^3 T_{av} Q_G} \quad (8)$$

$$c = \frac{6.785 \, x \, 10^{-6} T_{av} Q_G}{A_i} \quad (9)$$

$$d = \frac{Q_s + 5.615(Q_w + Q_o)}{600 A_i} \quad (10)$$

$$e = \frac{6f}{g D_h \cos(\theta)} \quad (11)$$

$$f = \left[ \frac{1}{1.74 - 2\log\left(\frac{2\varepsilon'}{D_h}\right)} \right]^2 \quad (12)$$

$$m = \frac{cde}{1 + d^2 e} \quad (13)$$

$$n = \frac{c^2 e}{(1 + d^2 e)^2} \quad (14)$$

$Q_S$ = Solid flow rate, ft$^3$/d
$Q_W$ = Water flow rate, bbl/d
$Q_O$ = Oil flow rate, bbl/d
$Q_G$ = Gas flow rate, Mscf/d
$S_S$ = Specific gravity of solids
$S_W$ = Specific gravity of water
$S_O$ = Specific gravity of oil
$S_G$ = Specific gravity of gas
$T_{av}$ = Average temperature, °R
$A_i$ = Pipe cross-sectional area, in$^2$
$g$ = Gravitational acceleration, 32.17 ft/s$^2$
$D_h$ = Hydraulic diameter, in
$\theta$ = Inclination angle, degrees
$\varepsilon'$ = Pipe wall roughness, in

FIG. 6B

Vogel IPR $$\frac{q}{q_{max}} = 1 - 0.2\left(\frac{P_{wf}}{\bar{P}}\right) - 0.8\left(\frac{P_{wf}}{\bar{P}}\right)^2$$

Where:

$q$ = Producing flow rate of fluids out of the well, $ft^3$/day $q_{max}$ = Maximum flow rate of fluids out of the well, $ft^3$/day $P_{wf}$ = Bottom hole pressure, psi $\bar{P}$ = Average reservoir pressure, psi

FIG. 7

Hagedorn & Brown Eqns.

$$\Delta P_f = \frac{2 f \rho_f V_m^2 L}{144 g_c D} \quad (1) \qquad \Delta P_g = \bar{\rho}_m g \Delta z \quad (2)$$

$$\bar{\rho}_m = \rho_L H_L + \rho_g (1 - H_L) \quad (3) \qquad H_L = \frac{H_L}{\psi} \times \psi \quad (4)$$

Where:

$$\psi = \begin{cases} 27170B^3 - 317.52B^2 + 0.5472B + 0.9999, & \text{if } B \leq 0.025 \\ -533.33B^2 + 58.524B + 0.1171, & \text{if } B > 0.025 \\ 2.5714B + 1.5962, & \text{if } B > 0.055 \end{cases} \quad (5) \text{ dimensionless}$$

$$B = \frac{N_{GV} N_{LV}^{0.38}}{N_D^{2.14}} \quad (6) \qquad \frac{H_L}{\psi} = \sqrt{\frac{0.0047 + 1123.32H + 729489.64H^2}{1 + 1097.1566H + 722153.97H^2}} \quad (7)$$

$$H = \frac{N_{LV}}{N_{GV}^{0.575}} \left(\frac{p}{14.7}\right)^{0.1} \frac{CN_L}{N_D} \quad (8) \qquad N_{LV} = 1.938\, v_{SL} \sqrt[4]{\frac{\rho_L}{\sigma_L}} \quad (9)$$

$$N_{GV} = 1.938\, v_{SG} \sqrt[4]{\frac{\rho_L}{\sigma_L}} \quad (10)$$

FIG. 9A

Hagedorn & Brown Eqns. Cont.

$$N_D = 120.872\ D\sqrt{\frac{\rho_L}{\sigma_L}} \quad (11)$$

$$v_{SG} = \frac{q_L\left(GLR - R_s\left(\frac{1}{1+WOR}\right)\right)}{86400A_p}\ \frac{14.7}{p}\ \frac{T_R}{520}\ \frac{z}{1} \quad (12)$$

$$v_{SL} = \frac{5.615q_L}{86400A_p}\left(B_o\frac{1}{1+WOR} + B_w\frac{WOR}{1+WOR}\right) \quad (13)$$

$$CN_L = 0.061\ N_L^3 - 0.0929\ N_L^2 + 0.0505\ N_L + 0.0019 \quad (14)$$

$$N_L = 0.15726\ \mu_L\sqrt[4]{\frac{1}{\rho_L\sigma_L^3}} \quad (15)$$

$$\sigma_L = \sigma_o\frac{1}{1+WOR} + \sigma_w\frac{WOR}{1+WOR} \quad (16) \qquad \mu_L = \mu_o\frac{1}{1+WOR} + \mu_w\frac{WOR}{1+WOR} \quad (17)$$

$$\rho_g = \frac{28.967\ SG_g\ p}{z\ 10.732\ T_R} \quad (18)$$

$$\rho_L = \frac{62.4\ SG_o + \frac{Rs\ 0.0764\ SG_g}{5.614}}{B_o}\frac{1}{1+WOR} + 62.4\ SG_w\ \frac{WOR}{1+WOR} \quad (19)$$

$$M = SG_o\ 350.52\ \frac{1}{1+WOR} + SG_w\ 350.52\ \frac{WOR}{1+WOR} + SG_g\ 0.0764\ GLR \quad (20)$$

FIG. 9B

Hagedorn & Brown Variables $A_p$ = flow area, $ft^2$
$B$ = correlation group, dimensionless
$C$ = coefficient for liquid viscosity number, dimensionless
$D$ = pipe diameter, ft
$h$ = depth, ft
$H$ = correlation group, dimensionless
$H_L$ = liquid holdup factor, fraction
$f$ = friction factor, dimensionless
$GLR$ = gas-liquid ratio, scf/bbl
$M$ = total mass of oil, water and gas associated with 1 bbl of liquid flowing into and out of the flow string, $lb_m$/bbl
$N_D$ = pipe diameter number, dimensionless
$N_{GV}$ = gas velocity number, dimensionless
$N_L$ = liquid viscosity number, dimensionless
$N_{LV}$ = liquid velocity number, dimensionless
$p$ = pressure, psia
$q_c$ = conversion constant equal to 32.174049, $lb_m ft / lb_f sec^2$
$q$ = total liquid production rate, bbl/d
$Re$ = Reynolds number, dimensionless
$R_s$ = solution gas-oil ratio, scf/stb
$\mu$ = absolute roughness, ft
$\rho$ = viscosity, cp
$\bar{\rho}$ = density, $lb_m/ft^3$
$\sigma$ = integrated average density at flowing conditions, $lb_m/ft^3$
$\psi$ = surface tension of liquid-air interface, dynes/cm (ref. values: 72 – water, 35 – oil)
$\varepsilon$ = secondary correlation factor, dimensionless $\Delta P_g$ = Gravitational pressure loss, psi
$\Delta P_f$ = Frictional pressure loss, psi
$SG_o$ = Specific Gravity Oil
$SG_w$ = Specific Gravity water
$SG_g$ = Specific Gravity gas
$B_o$ = Oil formation volume factor, bbl/stb
$B_w$ = Water formation volume factor, bbl/stb
$T$ = temperature, °R or °K, follow the subscript
$u$ = velocity, ft/sec
$WOR$ = water-oil ration, bbl/bbl
$z$ = gas compressibility factor, dimensionless

FIG. 9C

AUTOMATED METHOD FOR GAS LIFT OPERATIONS

CROSS REFERENCE TO RELATED APPLICATIONS

The present application claims priority to U.S. Provisional Application No. 62/893,976 filed on Aug. 30, 2019.

BACKGROUND

The use of injected gas, commonly known as gas lift, to aid in the production of liquids from a well is a balancing act. Over-injecting the gas will ensure lifting of liquids to the surface but will increase friction during the production process and may reduce fluid flow from the formation into the well. Under injection of the gas will fail to lift the liquids to the surface and will result in a buildup of fluids in the well further restricting flow of fluids and loss of production. Thus, the industry would benefit from methods and apparatus capable of continuously managing the gas injection rate to compensate for changes in production pressure.

SUMMARY OF THE INVENTION

In one aspect the present disclosure provides a method for controlling a compressor system for gas lift operations. The method includes the steps of:

operating the compressor system at an initial gas injection rate sufficient to lift all liquids from the well;

operating the compressor system for a first incremental period of time at a first incremental gas injection rate greater than the initial gas injection rate;

continuing to produce liquids from the well during the first incremental period while monitoring production pressure within the well;

determining the average production pressure over the incremental period;

operating the compressor system for second incremental period of time at a second incremental gas injection rate where the second incremental gas injection rate is greater than the first incremental gas injection rate;

continuing to produce liquids from the well during the second incremental period while monitoring production pressure within the well;

determining the average production pressure over the second incremental period;

operating the compressor system for a third incremental period of time at a third incremental gas injection rate where the third incremental gas injection rate greater than the second incremental gas injection rate;

continuing to produce liquids from the well during the third incremental period while monitoring production pressure within the well;

determining the average production pressure over the third incremental period;

identifying the incremental gas injection rate which produced the lowest production pressure while unloading all fluids from the well; and setting the identified incremental gas injection rate as the Operational Gas Injection Rate for the compressor system and operating the compressor system to produce all fluids from the well.

The described method may include additional incremental periods at greater gas injection rates.

Alternatively, the step of operating the compressor system for a first incremental period at a first incremental gas rate greater than the initial gas injection rate is replaced by a step that takes place for a first incremental period at a first incremental gas rate that is less than the initial gas injection rate. Subsequent incremental periods operate at incremental gas injection rates less than the prior incremental gas injection rates. Additional incremental periods may be added with each additional incremental period at a lower gas injection rate than the prior incremental period.

Alternatively, the step of operating the compressor system for a first incremental period at a first incremental gas rate greater than the initial gas injection rate is replaced by a step that takes place at a first incremental gas rate that is greater than the initial gas injection rate and subsequent incremental periods take place at incremental gas injection rates that are less than the first incremental gas injection rate. Additional incremental periods may be added with each additional incremental period at a lower gas injection rate than the prior incremental period.

Alternatively, the step of operating the compressor system for a first incremental period at a first incremental gas rate greater than the initial gas injection rate is replaced by a step that takes place at a first incremental gas rate that is less than the initial gas injection rate. Subsequent incremental periods take place at incremental gas injection rates that are greater than the prior incremental gas injection rates. Additional incremental periods may be added with each additional incremental period at a greater gas injection rate than the prior incremental period.

The described method may additionally include steps for determining the critical rate of injection. The Critical Rate mode comprises the steps of:

estimating the maximum flow rate of fluids out of the well ($q_{max}$) and the average reservoir pressure ($\overline{P}$) at the maximum flow rate of fluids out of the well;

measuring the production pressure using a bottom hole sensor or measuring the surface casing pressure using a surface sensor and calculating the production pressure;

calculate the total gas injection rate needed to unload all fluids from the wellbore using the measured or calculated production pressure and the estimated values of $q_{max}$ and $\overline{P}$;

comparing the calculated total gas injection rate to the gas injection rate which produced the lowest production pressure while unloading all fluids from the well, if the calculated total gas injection rate is within the tolerance range of the gas injection rate which produced the lowest production pressure while unloading all fluids from the well, then set the values of $q_{max}$ and $\overline{P}$ as static values for the calculation of the minimum gas injection rate necessary to unload the well of all liquids;

calculate the minimum gas injection rate necessary to unload the well of all liquids; and directing the compressor system to operate at the calculated minimum gas injection rate.

Additionally, in the Critical Rate Mode, the method may include the steps of:

monitoring fluid flow rates of water, gas, and oil out of the well;

monitoring bottom hole pressure or calculating bottom hole pressure by using a monitored surface casing pressure;

calculating the total gas flow rate needed to carry all fluids out of the well;

subtracting the flow rate of gas out of the well from the calculated total gas flow rate needed to carry all fluids out of the well to provide the minimum gas injection rate necessary to unload the well of all liquids; and operating the compressor system at the minimum gas injection rate necessary to unload the well of all liquids.

BRIEF DESCRIPTION OF THE DRAWINGS

FIGS. 6A-B provide the equations necessary to determine Guo critical rate mode when operating under the Critical Rate Mode.

FIG. 7 is the equation for determining the Vogel IPR parameters—$q_{max}$ and ($\overline{P}$).

FIGS. 9A-C provide Equations 1-20 known as the Hagedorn and Brown outflow model equations.

DETAILED DESCRIPTION

The drawings included with this application illustrate certain aspects of the embodiments described herein. However, the drawings should not be viewed as exclusive embodiments.

This disclosure provides improved methods for managing the operations of oil and gas wells operating under gas lift conditions. The improvements include enhancements to the compressor system 10 used to inject gas for gas lift operations and new methods for controlling compressor system 10 operation.

Improved Compressor System

The improved compressor system 10 includes modifications designed to manage the additional stresses imparted by the new methods. In particular, improved compressor system 10 has been engineered to withstand the stresses induced by operating under random and/or variable conditions.

Figure 1:
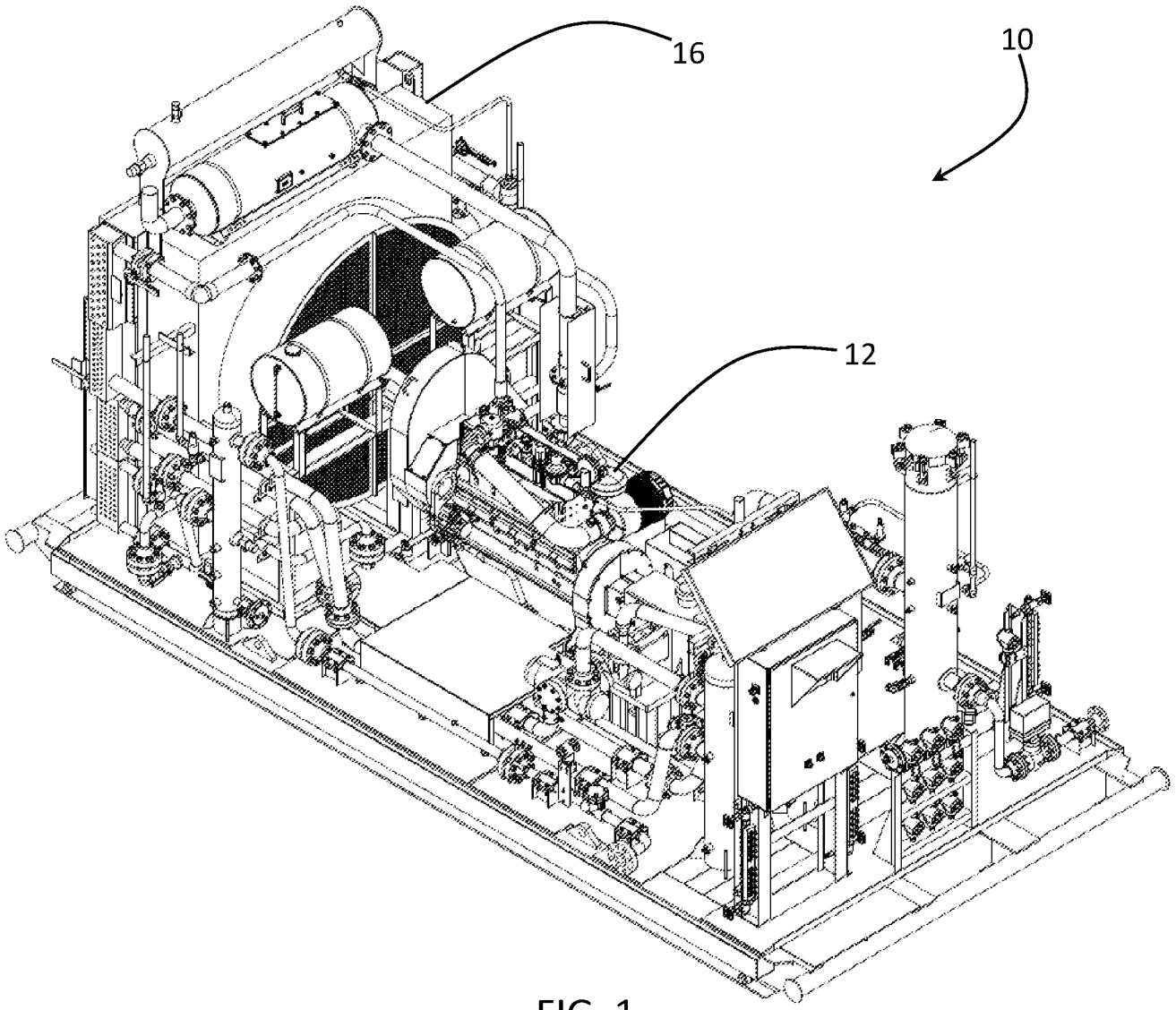
FIGS. 1-2 depict two perspective views of a skid supporting a compressor system suitable for use in the disclosed artificial gas lift method.
Figure 2:
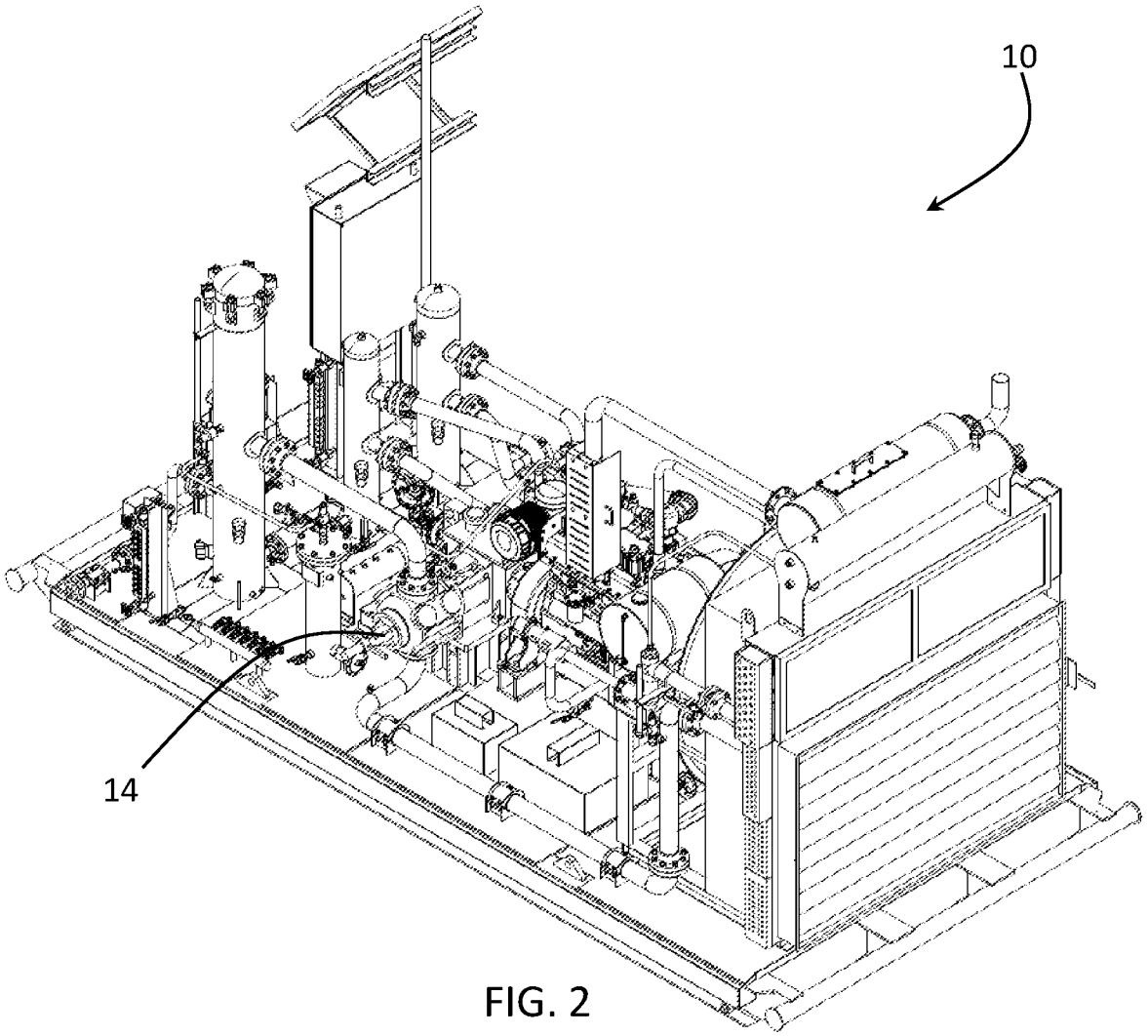
Figure 3:
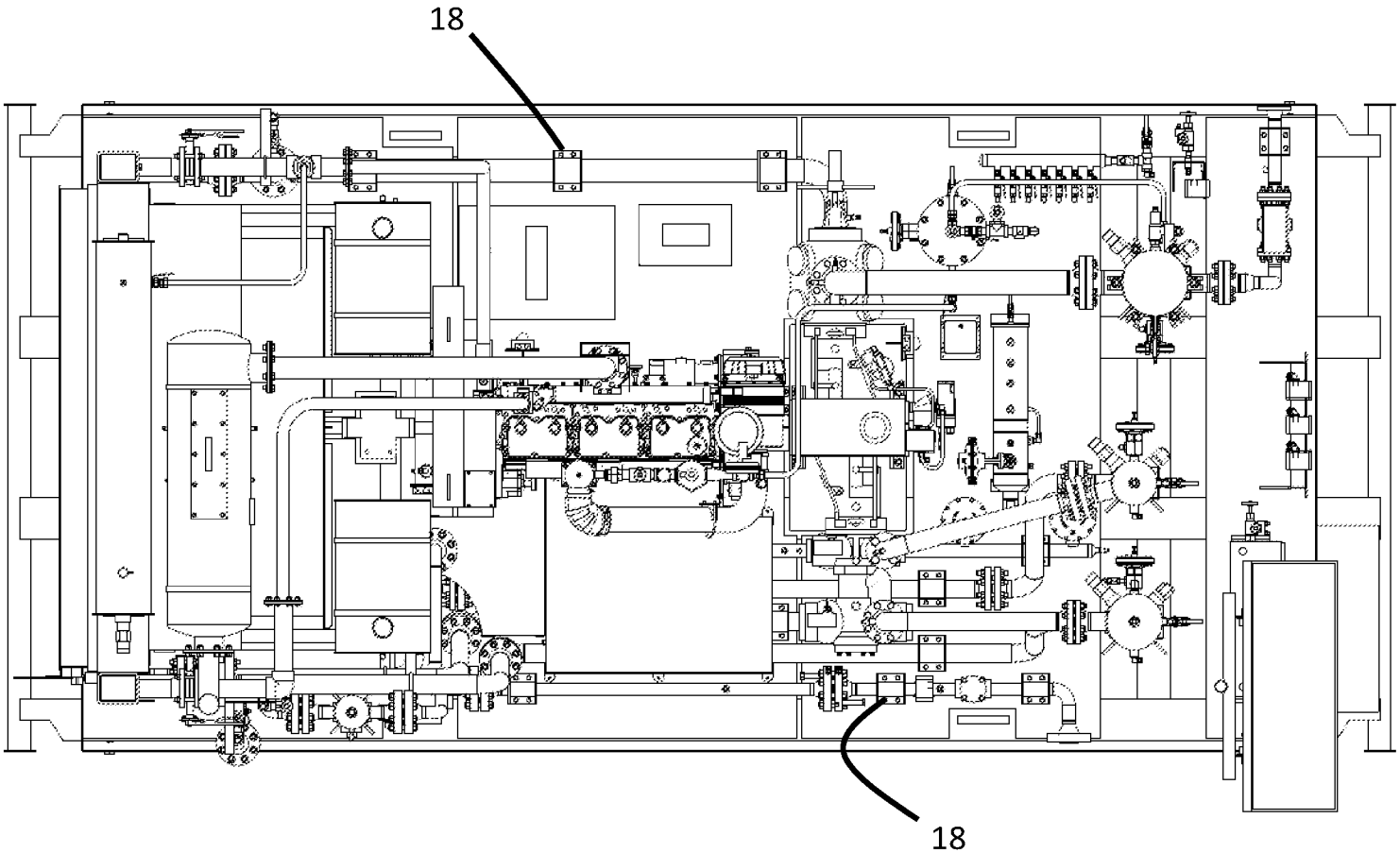
FIG. 3 depicts a top view of the skid supporting the compressor system suitable for use in the disclosed artificial gas lift methods.

Compressor system 10 will be described with reference to FIGS. 1-3. Compressor system 10 includes common components such as engine 12, reciprocating compressor 14 and radiator/fan assembly 16. Additionally, compressor system 10 includes a programmable logic controller (PLC), not shown, and a computer server, not shown, suitable for controlling operations of compressor system 10 and managing calculations necessary to carry out the methods disclosed herein. The computer server may be located at the wellsite or may be remotely located and accessed as a cloud server or other remote server. Typically, the computer server will perform the necessary calculations and control the operations of the PLC. However, any computer arrangement may be used to perform the operations necessary for carrying out the disclosed methods. For the purposes of conciseness, this disclosure will refer to the various computer control systems and arrangements as a computer server.

To accommodate the stresses imparted by the methods disclosed below, compressor system 10 incorporates pipe supports 18 designed to impart structural rigidity to the supported pipe in every direction. Use of pipe support 18 transfers vibrations and pulses from pipes or conduits to the skid portion of compressor system 10. Thus, as depicted in the FIGS., compressor system 10 is particularly suited for carrying out the following methods for automatically and continuously managing gas injection rates thereby improving well production.

Improved Methods for Gas Lift Operations

In addition to providing the improved compressor system 10, the present invention includes improved methods for controlling compressor system 10. The methods disclosed below provide the well operator with the ability to identify and maintain gas injection rates which result in the minimum production pressure. The minimum production pressure will be determined either by a bottom hole sensor or a casing pressure sensor located at the surface or any convenient location capable of monitoring pressure at the wellhead. As used herein, the term minimum production pressure refers to that pressure as determined by either a bottom hole pressure sensor, a surface casing pressure sensor or other sensor suitable for determining or calculating the pressure at the bottom of the production casing necessary to lift fluids from the well thereby precluding liquid loading of the well bore. By maintaining the minimum production pressure, the operator is able to operate at the minimum gas injection rate required to produce oil and gas from the well. The minimum gas injection rate reduces friction within the wellbore and improves operational efficiencies.

When initiating gas lift operation, the operator will typically operate at an injection rate based on the characterization of the well after well completion. In general, the initial gas injection rate is calculated based on the gas lift valving configuration, i.e. the type and location of the gas valves, used downhole and the amount of gas needed to unload a full column of liquid to above the first valve depth. The first valve is the valve closest to the surface. Typically, the initial gas injection rate is an estimate. If the initial gas injection rate permits production of the well, then the operator generally continues to use that injection rate. However, over time reservoir and surface conditions will change. In particular, changes in formation pressure, hydrocarbon flow rate into the wellbore and sales line pressure will impact production characteristics. As a result, the initial gas injection rate will not efficiently produce oil from the well for the life of the well.

The following method provides the ability to continuously adjust operation of compressor system 10 to ensure a gas injection rate which provides the minimum production pressure necessary to lift fluids from the well. The disclosed method has two primary components or modes. As used herein, the first primary component is referred to herein as the "Hunt Mode" and the second primary component is referred to herein as the "Critical Rate Mode." The Critical Rate Mode relies upon data developed during performance of the Hunt Mode. Optionally, the Hunt Mode may be used with or without practice of the Critical Rate Mode.

Hunt Mode

The Hunt Mode begins with the initial gas injection rate as determined based on factors described above. The methods for determining the initial gas injection rate are well known to those skilled in the art. Thus, the Hunt Mode focuses on determining the minimum gas injection rate corresponding to the minimum production pressure through manipulation and control of compressor system 10.

Figure 4:
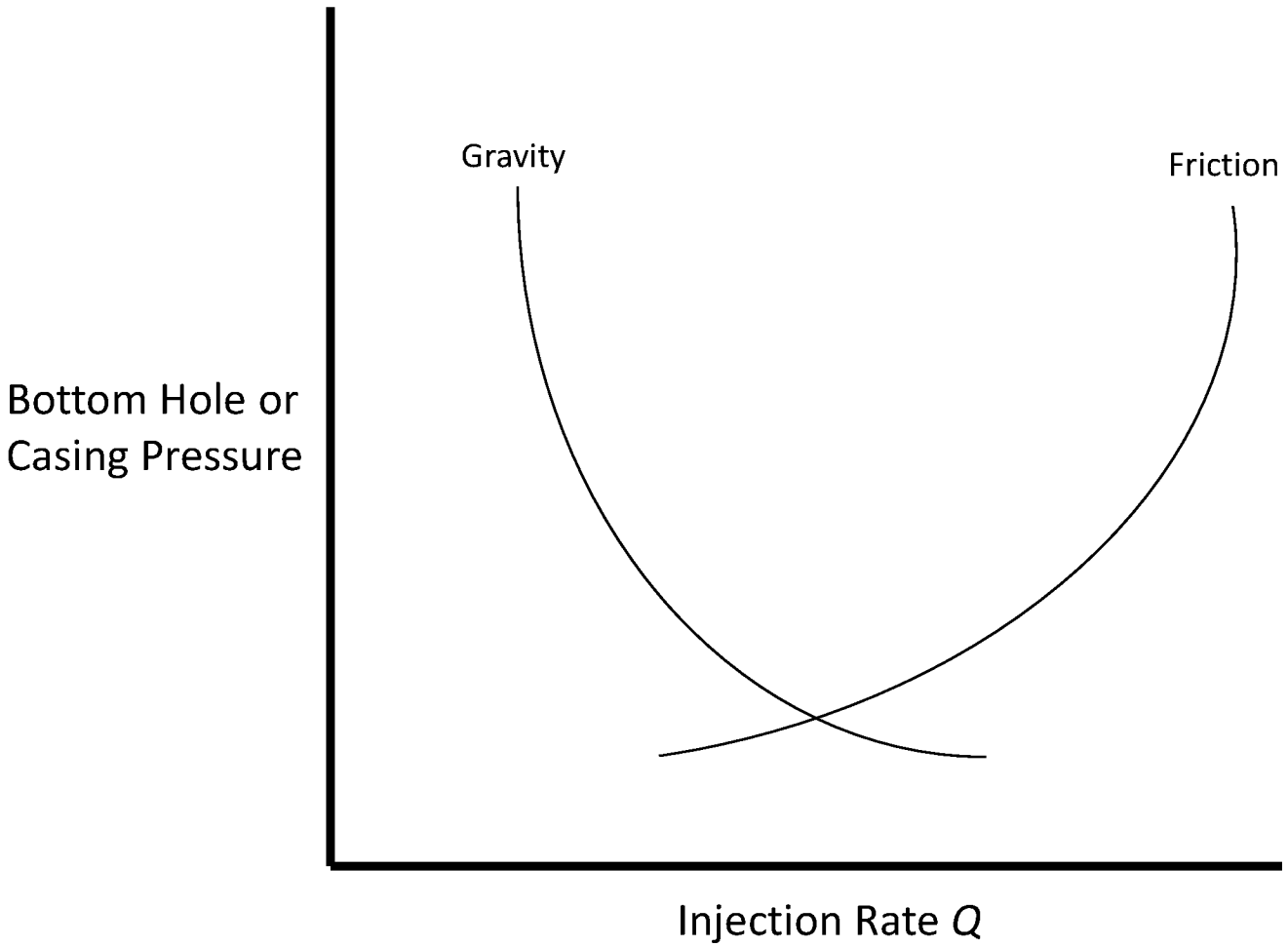
FIG. 4 is a graph comparing fluid specific gravity to friction over a range of injection rates and corresponding production pressures.

In general, operating compressor system 10 at a gas injection rate which provides the minimum production pressure will produce a graph which corresponds to FIG. 4. FIG. 4 represents the specific gravity ($S_g$) of the well fluid mixture produced under varying gas injection rates and the friction resulting from production of wellbore fluids at the varying gas injection rates. The low point of the graph, where the gravity and friction lines intersect, will generally represent the minimum gas injection rate suitable for production of oil and other liquids at the minimum production pressure as determined by the available sensors. If the well includes a bottom hole pressure gauge or sensor then the value provided by the sensor is evaluated as the production pressure; however, if a bottom hole pressure gauge is not available, then a pressure gauge or sensor on the surface casing will be used for estimating or determining the production pressure. Gas injection rates less than the intersection point will preclude the well from producing hydrocarbons at its maximum flow rate ($q_{max}$) under that gas lift design. As a result, the wellbore will load up with unproduced liquids. However, over-injecting gas will create additional friction during gas lift and preclude unloading at best efficiency.

The Hunt Mode provides for incremental alteration of injection rates above and below the initial gas injection rate. The method may be repeated after a period to time to readjust the gas injection rate to account for changes in reservoir and/or surface conditions. During the Hunt Mode, the gas injection rate is manipulated in a stepwise manner in order to identify the gas injection rate necessary for the minimum production pressure to lift wellbore fluids to the surface.

When operating in the Hunt Mode, the system identifies the desired gas injection rate using a range of injection rates. The hunt range of injection rates may vary from the prior injection rate by about 200 thousand standard cubic feet per day (mscfd) to about 1000 mscfd or up to the capacity of the compressor unit. More typically, the hunt range will vary injection rates from about 500 mscfd to about 700 mscfd.

The Hunt Mode will generally increase or decrease the injection rate in a stepwise incremental manner with the number of steps necessary to cover the entire selected range determined by the incremental change in injection rate. Each step of incremental change will be held for a defined time period, the incremental period. Typically, the incremental period will be between about 24 hours and 72 hours. More typically, the incremental period will be about 48 hours. During each incremental period, production pressure will be monitored. While monitoring of production pressure may take place for the duration of the incremental period, averaging of production pressure does not. To provide an accurate assessment of production pressure at the selected incremental injection rate, the well must be allowed to stabilize at that injection rate. Therefore, pressure averaging will take place only after well stabilization. Thus, pressure data obtained during the first 5% to 15% of the incremental period will be discarded. In other words, the average production pressure is determined over the last 85% to 95% of the incremental period. More typically, pressure data obtained during the first 10% of the incremental period will be discarded.

In one embodiment, the Hunt Mode will follow a predetermined pattern of step-up and step-down injection rates. In this embodiment, the first increment is a step-up or step-down where the gas injection rate is increased by a defined amount above the initial gas injection rate. If the first incremental period is a step-up, the increase may be between about 25 mscfd to about 100 mscfd. A typical increment for the step-up gas injection rate is about 20 mscfd or about 25 mscfd. The step-up gas injection rate will continue for the incremental period, typically 48 hours. Thus, if the initial gas injection rate is 600 mscfd, the step-up gas injection rate will take place for the incremental period of time at a rate of 625 mscfd. During the step-up gas injection, production pressure is monitored for an increase in pressure.

Each step-down or step-up increment will continue for the defined incremental period, typically 48 hours. Step-down increments may range from about 10 mscfd to about 100 mscfd. A typical increment for the step-down gas injection rate is about 20 mscfd or about 25 mscfd. After input of the incremental change and the total hunt range, one can determine the total number of step-down increments necessary to cover the hunt range of injection rates. As noted above, this determination will generally be carried out automatically by the programming associated with compressor system 10. Thus, the Hunt Mode will require five step-down steps for a hunt range of 625 mscfd to 500 mscfd and a step-down increment of 25 mscfd. During each incremental step-down of gas injection rate, the production pressure, as determined by either bottom hole pressure or surface casing pressure, will be monitored and averaged as determined by the available sensors. As noted above, data obtained during the initial portion of the incremental period will be discarded. For clarity, a bottom hole pressure sensor is located at the bottom of the vertical portion of the wellbore and a surface casing pressure sensor is located at the surface in a portion of the production tubing.

Upon completion of all step-up and step-down incremental periods, the gas injection rate which produced the lowest production pressure is identified as the new Operational Gas Injection Rate, i.e. the solution. Compressor system 10 is set at the Operational Gas Injection Rate and allowed to maintain that rate for a defined production period of time. The defined production period for continuous operation at the Operational Gas Injection Rate will vary from well to well depending on factors such as effective reservoir size, reservoir pressure, the proximity of adjacent wells and surface conditions such as pressure and flow in the sales line. Ultimately, the user will define how long, in their estimation, the solution should be used before repeating the Hunt Mode or utilizing the Critical Rate Mode described below. The well operator will also have the option of cutting short the selected period of operation at the solution in response to monitored conditions. Upon completion of the defined production period or a shorter period of time, the above described Hunt Mode can be repeated to determine a new Operational Gas Injection Rate.

The Hunt Mode for determining the minimum production pressure is not limited to initially operating with a first step-up increment followed by a series of step-down increments. Rather, the method may cover the entire hunt range of gas injection rates by incrementally increasing the gas injection rate from the initial gas injection rate to a desired higher gas injection rate. Likewise, the method may cover the entire hunt range of gas injection rates by incrementally decreasing the gas injection to a final lower gas injection rate. As described above, each incremental step will be for a defined incremental period at a defined incremental change in gas injection rate. Additionally, during each incremental period, the production pressure will be monitored and averaged after allowing the well to stabilize at the incremental gas injection rate.

In a preferred embodiment, the computer server associated with compressor system 10 is programmed on-site or remotely by the well operator with each variable discussed above. The computer server may be programmed to manage the methods described herein using conventional programming language. One skilled in the art will be familiar with programming code necessary to direct operation of compressor system 10 in accordance with the steps outlined herein. Each incremental step is monitored by compressor system 10 and reported by any convenient method, e.g.

electronically, to the operator. Finally, the computer server associated with compressor system 10 calculates the average production pressure using the data obtained during each incremental step and selects the injection rate corresponding to the lowest average production pressure for subsequent continuous operations at the well. Upon completion of the user defined interval for continuous operation, either the well operator or compressor system 10 repeats the Hunt Mode to readjust the Operational Gas Injection Rate to account for changes in the downhole environment.

In summary, when practicing the Hunt Mode, the user or well operator will provide the initial gas injection rate as determined based on the gas lift valve design or when implemented on a currently producing gas lift system the current injection rate used to achieve production. The user will then define the hunt range, the incremental change in gas injection rate and the number of increments to be used during the determination of the minimum production pressure. The conditions of the incremental period that produced the minimum production pressure are noted for use in the following Critical Rate Mode. Finally, the operator will define and input the length of the production period under which the well will operate at the Operational Gas Injection Rate determined by the Hunt Mode to provide the desired minimum production pressure.

Thus, the Hunt Mode can be described as follows:

Enable automatic gas injection management mode start timer expires and compressor system 10 begins the managed gas injection rate hunt process incremental injection rates and incremental periods of time are enabled and performed during each incremental period, compressor system 10 ignores data during the first portion (5% to 15%) of the incremental period, upon stabilization of the well at the injection rate, monitored production pressure is then averaged for the remainder of each incremental period and recorded by compressor system 10 after all incremental injection rates for the incremental periods are completed, compressor system 10 determines which injection rate produced the lowest average production pressure compressor system 10 adjusts gas injection rate to correspond to the identified injection rate which produced the lowest average production pressure and maintains this identified gas injection rate for the defined production period upon expiration of the defined production period, compressor system 10 repeats these operations to establish a new gas injection rate appropriate for maintaining the lowest production pressure.

As an example of gas injection rate management using the Hunt Mode, consider operation of a gas lift well currently producing with a predetermined gas injection rate of 600 mscfd. Prior to initiating the gas injection management method, the operator determines the hunt range. In this instance, a hunt range of 500 mscfd to 640 mscfd is selected. An initial step-up increment of 40 mscfd is selected and subsequent step-down increment of 20 mscfd is selected. Thus, the first increment will provide the initial step-up to 640 mscfd while seven step-down increments will be required to reach the low end of 500 mscfd. In this example, the operator determined that the step-up increment will take place over a single 48-hour incremental period. Likewise, the operator determined that each step-down increment occurs over incremental periods of 48 hours. Thus, upon completion of the step-up increment, the well will then operate at a gas injection rate of 620 mscfd for an incremental period of 48 hours. Each subsequent step-down increment will also take place for a defined incremental period of 48 hours. The operator has also established the defined production period as the three weeks following determination of the gas injection rate which provides the lowest production pressure.

Upon enablement of the Hunt Mode, the computer server associated with compressor system 10 begins by directing the step-up increment. Thus, in this example, compressor system 10 operates at 640 mscfd for an incremental period of 48 hours and determines an average production pressure over the last 43.2 hours of the step-up incremental period.

Upon completion of the defined incremental period for the step-up increment, the computer server associated with compressor system 10 directs operations at each step-down incremental period for the defined length of time. Thus, upon initiation of the first step-down incremental period of 48 hours, the gas injection rate is reduced to 620 mscfd. Each successive step-down incremental period operates at the defined incremental reduction in gas injection rate of 20 mscfd until the final step-down increment of 500 mscfd. As discussed above, the average production pressure will be determined over the last 43.2 hours of each step-down incremental period.

Upon completion of the last incremental period, the computer server associated with compressor system 10 identifies the gas injection rate associated with the lowest average production pressure for a defined incremental period. The identified gas injection rate is designated as the Operational Gas Injection Rate. Then, the computer server associated with compressor system 10 adjusts automatically to continue production of the well at the new Operational Gas Injection Rate. The computer server associated with compressor system 10 will maintain the selected Operational Gas Injection Rate for a period of three weeks as defined by the operator. Upon completion of the three-week or other selected time period, the solution rate can be used to enable the Critical Rate Mode of operation. If insufficient data is available after the selected time period to enable Critical Rate Mode operation, the process will be repeated using the same values for step-up, step-down and the defined incremental periods of time unless altered by the operator. Thus, the Hunt Mode provides for repeated adjustment of the Operational Gas Injection Rate to maintain well operation at the injection rate which provides the minimum production pressure.

The Hunt Mode provides a marked improvement over traditional gas lift operations; however, the Hunt Mode does not provide for continuous real time or even daily adjustment of the gas injection rate. Fortunately, data necessary to continuously update the gas injection rate can be obtained by continuously monitoring the production rate; average production tubing pressure, average production pressure, average sales line pressure. These values and others as discussed below are used in the Critical Rate Mode. While the Hunt Mode can be considered an empirical determination of the desired gas injection rate, the Critical Rate Mode builds on the Hunt Mode empirical solution and provides a continuously updated calculated value of the gas injection rate necessary to produce wellbore fluids to the surface at the minimum production pressure. Thus, the Critical Rate Mode provides continuous fine tuning of the gas injection rate thereby improving production efficiency of the well. Further, the Critical Rate Mode utilizes the current gas production rate of the well and adjusts the gas injection rate accordingly to avoid over-injecting and under-injecting the well. Thus, the Critical Rate Mode operates at the minimum gas injection rate, i.e. the critical rate, necessary to unload the well of all liquids.

Critical Rate Mode

Figure 5A:
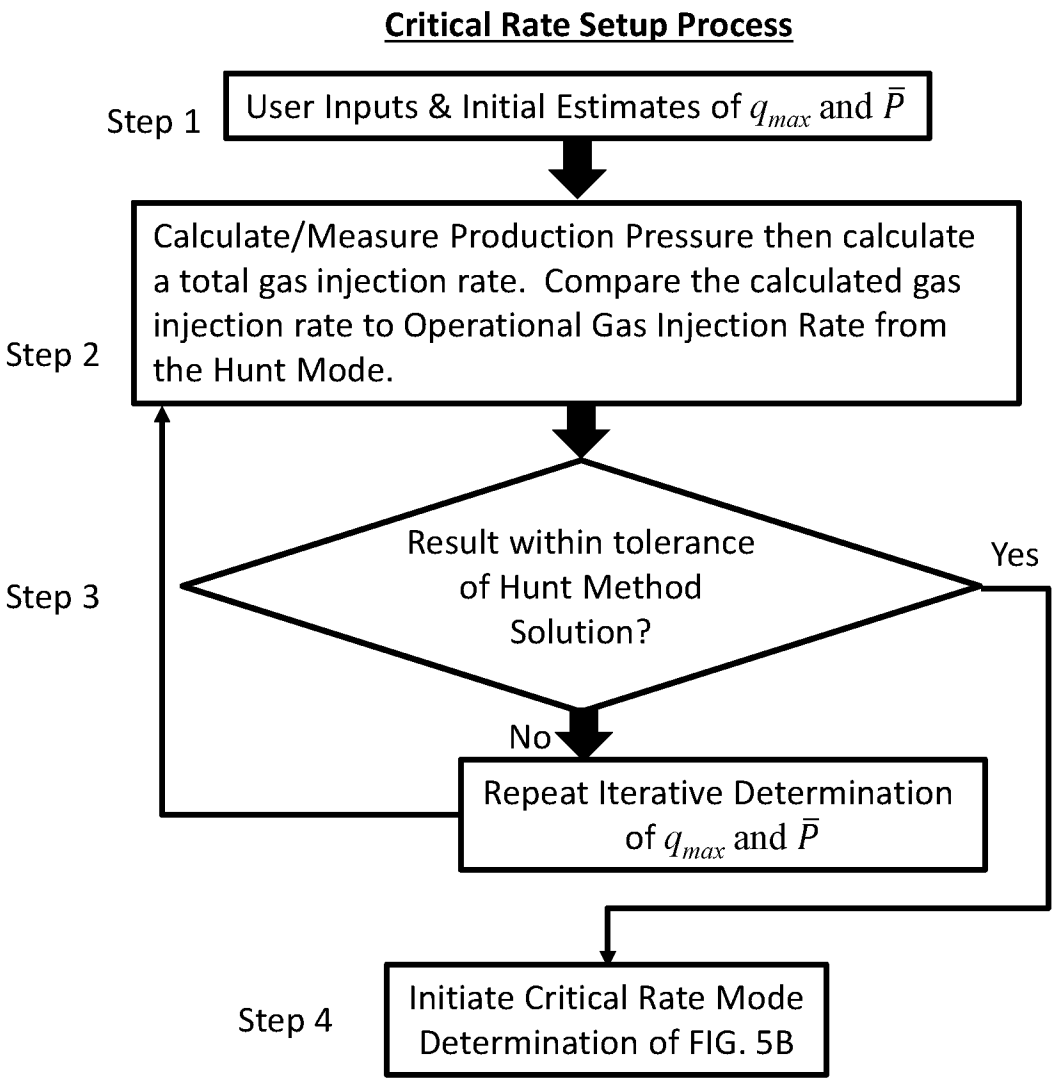
FIGS. 5A and 5B are flow charts depicting the steps for determining the critical rate of injection necessary to precluding loading of a well operating under gas lift conditions.
Figure 5B:
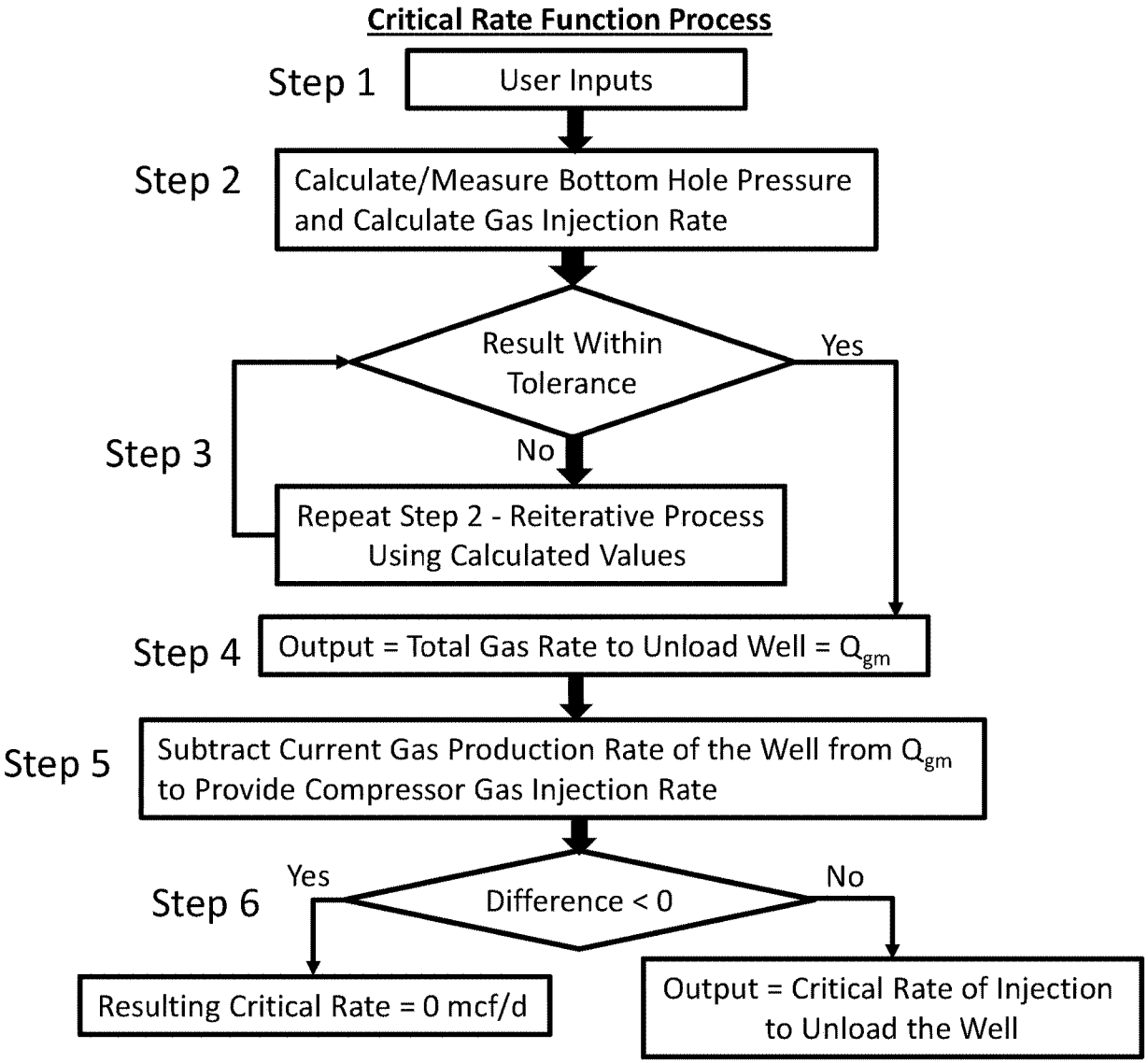

The Critical Rate Mode will be discussed with reference to FIGS. 4-9. FIGS. 5A and 5B provide process flow diagrams of the operations carried out by the computer server associated with compressor system 10 to determine the gas injection rate needed to unload fluids from the wellbore at a given production pressure, i.e. the critical rate of gas injection. In performing the operations, the computer server can use production pressure data as measured directly by a gauge or sensor or the computer server may calculate the production pressure, as described below, using the Hagedorn and Brown equations of FIGS. 9A-B and a surface casing sensor.

FIG. 5A provides the process flow diagram for determining the static Vogel IPR parameters of: $\overline{P}$=Average reservoir pressure, psi; and, $q_{max}$=Maximum flow rate of fluids out of the well, $ft^3$/day or barrels per day. In general, the units used in either Mode can be adjusted by programming to accommodate the units commonly used by those in the field. FIG. 5B incorporates the Vogel IPR parameters produced by FIG. 5A as static values and utilizes real time production pressure data or calculated production pressure data and fluid flow rates out of the formation to adjust the critical rate of gas injection. The operations described by the process flow diagrams of FIGS. 5A and 5B are programmed into the computer server associated with compressor system 10. Thus, the processes of FIGS. 5A and 5B provide the ability to control the operation of compressor system 10 when operating under the Critical Rate Mode.

As will be described in more detail below, the process flow diagram of FIG. 5B utilizes the Hagedorn and Brown Equations of FIGS. 9A and 9B to calculate a production pressure based on the measured surface casing pressure and the calculated gravitational pressure loss $\Delta P_g$ (psi, Equation 1) and calculated frictional pressure loss $\Delta P_g$ (psi, Equation 2) over the vertical distance of the wellbore. The calculated production pressure value is then used in the GUO equation provided at the top of FIG. 6A to calculate the rate of gas injection for use in Step 2 of FIG. 5B. However, if the well has a bottom hole pressure gauge, then the step of using Hagedorn and Brown of FIGS. 9A and 9B can be skipped and the measured production pressure inserted into the GUO equation for use in Step 2 of FIG. 5B.

The iterative process of FIG. 5A utilizes data obtained from the incremental period of the Hunt Mode which produced the Operational Gas Injection Rate. Additionally, the process of FIG. 5A utilizes operator input relating to the configuration of the well and the configuration of the gas valves installed in the completed well.

Figure 8:
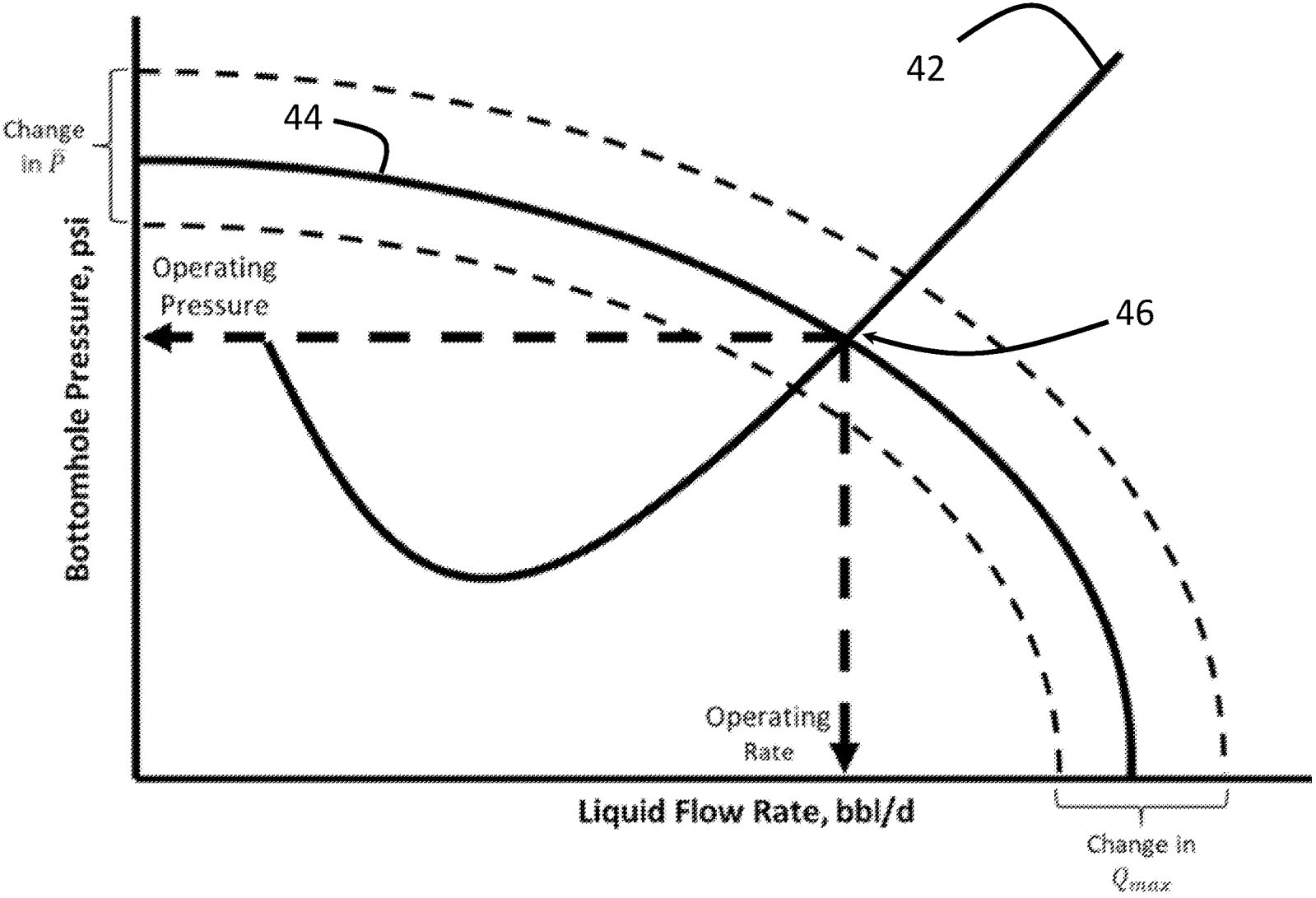
FIG. 8 is the intersection of the Hagedorn-Brown outflow curve with the Vogel IPR curve.

In Step 1 of FIG. 5A, the operator provides an initial estimate of $q_{max}$ and $\overline{P}$. With reference to FIG. 8, a starting point for the initial estimate of P (average reservoir pressure) is the normal pressure gradient commonly used to estimate the reservoir pressure and the starting point for the initial estimate of $q_{max}$ (maximum flow rate of fluids through the borehole of the well) is a value equal to double the well's current production rate. When the well in question is part of a larger reservoir, then engineering knowledge of offset wells and data collected from reservoir can be used to establish the initial estimates of $\overline{P}$ and $q_{max}$. As discussed below, the estimated values are merely the initiation of the process as the method provides an iterative process for establishing the static values of $\overline{P}$ and $q_{max}$. Therefore, the initial best guess will be sufficient to begin the described method and one skilled in the art of hydrocarbon production will be readily capable of providing a reasonable initial estimate of these values. In Step 1, user inputs and other data points will include the following properties relating to the completed wellbore and wellbore operations during the Hunt Mode:

- estimated $q_{max}$—maximum flow rate of fluids through the borehole of the well
- $\overline{P}$—Average reservoir pressure
- true vertical depth (TVD) of the well, feet
- measured depth (MD) of the well, feet
- total production tubing length, feet
- inner diameter of casing, inches
- inner diameter of production tubing, inches
- valve design and depth relative to MD and TVD, and closing pressure of each valve, in psi
- $Q_S$=Solid flow rate, $ft^3$/d
- $Q_W$=Water flow rate, bbl/d
- $Q_O$=Oil flow rate, bbl/d
- $Q_G$=Gas flow rate, Mscf/d
- $S_S$=Specific gravity of solids, as determined by the operator
- $S_W$=Specific gravity of water, as determined by the operator
- $S_O$=Specific gravity of oil, as determined by the operator
- $S_G$=Specific gravity of gas (air=1, natural gas approximately 0.7 to 0.85 as determined by the operator)
- $T_{av}$=Average temperature, calculated based on monitored surface temperature and estimated bottom hole temperatures
- $A_i$=Pipe cross-sectional area, $in^2$ as calculated based on the tubing inside diameter
- g=Gravitational acceleration, 32.17 $ft/s^2$
- $D_h$=Hydraulic diameter, in (is calculated based on user definition of flow)
- θ=Inclination angle, degrees as calculated
- ε'=Pipe wall roughness, in (an assumed value for wellbore pipe)
- $T_{bh}$=bottom hole temperature (may be an estimate)
- $Q_{gm}$=total air/gas injection rate required to carry liquid droplets (scf/min) as calculated by the iterative process of FIG. 5B
- $E_{km}$=minimum kinetic energy required to carry liquid droplets ($lb_f$-$ft/ft^3$) as calculated by iterative process of FIG. 5B
- $P_{hf}$=production pressure (psi) as measured by a bottom hole sensor or calculated per the equations of FIGS. 9A-C The variables identified in association with the Hagedorn & Brown equations of FIGS. 9A-C include inputs and calculated values known to those skilled in the art.

Following Step 1, completion of the operations of FIG. 5A requires an iterative determination (Steps 2 and 3) to produce the static Vogel IPR parameters of $q_{max}$ and $\overline{P}$ corresponding to the gas injection rate that will produce a minimum production pressure within the tolerance range of the Operational Gas Injection Rate identified during the Hunt Mode and the wellbore schematic. The acceptable tolerance range for purposes of setting $q_{max}$ and $\overline{P}$ is that injection rate within about 5% of the Operational Gas Injection Rate that produced the Minimum Production Pressure associated with the Incremental Period.

As discussed above, Step 1 includes an initial estimate of the values of $q_{max}$ and $\overline{P}$. In Step 2, the operator or the computer server associated with compressor 10 uses the Hagedorn & Brown equations of FIGS. 9A and 9B to solve for a production pressure. However, if a downhole pressure gauge is used then the production pressure is provided by the direct measurement. Following determination of the production pressure by calculation or direct measurement, Step 2 uses the GUO equations of FIGS. 6A and 6B to solve for the total gas injection rate needed to unload fluids from the well and compares the total gas injection rate to the Operational Gas Injection Rate from the Incremental Period that produced the Minimum Production Pressure. In Step 3, the operator or computer determines if the total gas injection rate is within an acceptable tolerance range when compared to the Operational Gas Injection Rate. If not then they edit $q_{max}$ and $\overline{P}$ and continue the iterative process until values within the tolerance range are obtained.

Thus, the Hunt Method Operational Gas Injection Rate provides the target value for the GUO solution. If the initial estimates of $q_{max}$ and $\overline{P}$ produce a gas injection rate value within about 5% of the Operational Gas Injection Rate for the Incremental Period that produce the Operational Gas Injection Rate, i.e. the tolerance range, then the system or user establishes the $q_{max}$ and $\overline{P}$ as the Vogel static values. If the value of the initially determined gas injection rate produces a GUO solution value outside of the tolerance range, the system or user will perform iterative calculations by changing the initial estimate of $q_{max}$ and $\overline{P}$ and repeating steps 2-3 until the determined total gas injection rate, when compared to the Operational Gas Injection Rate from the Hunt Mode that produced the Minimum Production Pressure, is within the indicated 5% tolerance range.

The Vogel static values of $q_{max}$ and $\overline{P}$ provide the Vogel Curve identified in FIG. 8. Upon establishment of the Vogel Curve, the user will then set compressor system 10 to operate in Critical Rate Mode as determined by FIG. 5B. In addition to depicting the Vogel Curve, the graph of FIG. 8 depicts the Hagedorn & Brown model for injection rates at various production pressures and fluid flow rates from the reservoir into the well. The intersection of the Hagedorn and Brown outflow model 42 at the gas injection rate with the Vogel IPR Curve 44 identifies the production pressure (bottom hole pressure) needed to calculate the $Q_{gm}$ point 46, i.e. the minimum gas flow rate required to unload liquid from the well, at the static values of $q_{max}$ and $\overline{P}$, as determined by the GUO equation at the top of FIG. 6A. Thus, FIG. 8 provides a visualization of changes in the $Q_{gm}$ values in response to changes in production pressure ($P_{wf}$ in FIG. 7 and $P_{hf}$ in FIG. 6A) and fluid flow rates ($Q_o$ oil flow in bbl/d, $Q_g$ gas flow in mscfd, $Q_w$ water flow in bbl/d) during the course of production from the well.

When operating in the Critical Rate Mode the computer server follows the process flow diagram of FIG. 5B. In Step 1, the computer server receives the static values for $q_{max}$ and $\overline{P}$ from the operator, or from the memory portion of the computer server corresponding to the data use in Step 1 of FIG. 5A. Additionally, Step 1 of FIG. 5B, uses live sensor data directed to fluid flow rates ($Q_o$ oil flow in bbl/d, $Q_g$ gas flow in mscfd, $Q_w$ water flow in bbl/d) and data corresponding to monitored production pressure or surface casing pressure suitable for calculating production pressure. Data values may be transmitted directly from the respective sensors to the computer server or may be input manually by the operator. Preferably, the data is entered in real time as an upload from the sensors. The frequency of monitoring fluid flow rates and monitoring/calculating production pressure is operator dependent as determined by the nature of the well. Compressor system 10 is capable of calculating a new critical rate of gas injection as frequently as the sensors can provide the relevant data. Thus, the limiting factor in updating the critical rate of gas injection will be the ability of the sensors to transmit data and/or the ability of compressor 10 to respond to the new input provided by the computer associated with compressor system 10.

When operating under the process flow diagram of FIG. 5B, the receipt of new data by the computer associated with compressor system 10 will trigger the operation of Step 2. In Step 2, if the well has a bottom hole pressure sensor the new bottom hole, the new production pressure value is used directly in Equation 1 of the GUO equations provided in FIG. 6A. Additionally, the monitored values for ($Q_o$ oil flow in bbl/d, $Q_g$ gas flow in mscfd, $Q_w$ water flow in bbl/d) are used in Equation 1 of FIG. 6A. One skilled in the art will recognize that Equation 1 is a condensed equation and that equations 2-14 provide for expansion and determination of $Q_{gm}$. These calculations are performed by the computer associated with compressor system 10. Briefly, the operation initially sets Equation 1 to equal zero. Subsequently, in step 3, the value of $Q_{gm}$ is solved iteratively using the Newton-Raphson Method for approximating the root of a function. The computer associated with compressor system 10 will continue the iterative calculation by adjusting the value of $Q_{gm}$ until the final resulting value is within about 1 mscfd to about 5 mscfd of the previous iterated value. Typically, the target variation between the final resulting value of $Q_{gm}$ and the previously iterated value is 5 mscfd.

If a bottom hole pressure sensor is not used in the well, the process flow diagram of FIG. 5B allows for utilization of a surface casing pressure gauge or sensor in the calculation of the total gas flow rate, $Q_{gm}$. Under these conditions, the surface pressure casing sensor provides data to the computer associated with compressor system 10. Then in Step 2, the computer server calculates the production pressure value using the Hagedorn & Brown equations of FIGS. 9A and 9B. In this case, the production pressure corresponds the surface casing pressure plus the pressure values corresponding to the calculated gravitational pressure loss $\Delta P_g$ (psi)(Equation 1) and calculated frictional pressure loss $\Delta P_g$ (psi)(Equation 2) over the vertical distance of the wellbore. The remaining equations of FIGS. 9A and 9B provide values necessary for resolving Equation 1 and Equation 2. Then, in Step 3, the resulting calculated production pressure is then used in the GUO Equation 1 of FIG. 6A, as discussed above with regard to the measured production pressure, to calculate the total gas flow rate $Q_{gm}$ in mscfd necessary to unload liquids from the well.

In Step 3 of FIG. 5B, compressor system 10 determines whether or not the iterative process of Step 2 has produced a solution value within 5 mscfd of the prior iterative answer. If this value is also within the tolerance range of about 5.0% then the computer associated with compressor system 10 proceeds to Step 4 and uses the calculated $Q_{gm}$ as the total gas flow required to unload fluids from the well. In Step 5, the current gas product rate from the well is subtracted from $Q_{gm}$ to provide a final Critical Gas Injection rate. As reflected by Step 6, if the final Critical Gas Injection rate is greater than zero, then the final Critical Gas Injection rate is used to unload the well. If the value is less than zero, the gas lift is not needed to produce fluids.

In Step 3, if the initial calculated $Q_{gm}$ point falls outside of the accepted tolerance range, then the iterative calculation process continues using the Newton-Raphson Method until the $Q_{gm}$ value falls within the predetermined tolerance range for the $Q_{gm}$ value.

FIG. 8 provides a visual interpretation of the intersection of the solution rate of FIG. 5B with the Vogel IPR parameters. The dashed curves show how changing the values of the Vogel IPR parameters of variables $q_{max}$ and $\overline{P}$ (maximum flow rate and average reservoir pressure) can affect the intersection value of the Hagedorn & Brown production pressure, which is used to find the GUO critical gas injection rate. Additionally, the solid hooked curve labeled Hagedorn-Brown Model depicts how changes in production pressure and fluid production rate influence the gas flow rate needed to produce fluids. Finally, the point labeled $Q_{gm}$ identifies the critical rate of gas needed to unload liquids from the well at the minimum production pressure. This critical gas rate is provided by GUO solution and then the computer will subtract the measured gas production rate of the well from the GUO critical rate solution to provide the computer instructed gas injection rate used by the compressor.

To summarize FIG. 5B, upon identification of the static values for variables $q_{max}$ and $\overline{P}$, compressor system 10 initiates calculation of the gas injection rate using the entire flow chart of FIG. 5B. Compressor system 10 uses the static IPR values from FIG. 5A in Steps 1-2 to generate a gas injection rate for use in Step 3. The calculations performed in Steps 1-2 also use the most recently measured production pressure ($P_{hf}$) and the most recently determined fluid production rate for all fluids produced by the well (q). Thus, Step 4 provides an output equal to the total gas flow from the bottom of the well necessary to unload the well. In Step 5, the computer subtracts the value corresponding to the current net gas produced by the well from the total gas flow of Step 4. If the resulting value is greater than zero, the resulting value is used as the current gas injection rate. If the resulting value is less than zero, then gas injection is not required to unload the fluids from the well.

To exemplify the control over the gas injection rate provided by the Critical Rate Mode, we can assume that upon completion of the Hunt Mode, compressor system 10 identified 620 mscfd as the minimum gas injection rate associated with the defined time period of the Hunt Mode which produced the lowest average production pressure for production of the well. Upon identification of the minimum gas injection rate by the Hunt Mode, compressor system 10 automatically stores this value in its memory or the operator records the value for future reference. In this instance, the operator stored or retrieved the following values as corresponding to the gas injection rate of 620 mscfd determined by the Hunt Mode: 750 lbs/in$^2$ as the average production pressure ($P_{csg}$ surface casing pressure in lbs/in$^2$ or $P_{wf}$=production pressure, lbs/in$^2$), the average tubing pressure 125 lbs/in$^2$ ($P_{tbg}$ in lbs/in$^2$) and 250 $Q_o$ oil flow in bbl/d, 350 $Q_w$ water flow in bbl/d, and 898 $Q_g$ gas flow in mscfd as the fluid production rate). Additionally, as noted above, the variables necessary for the determination of Equations 1-20 in FIGS. 9A-C and Equations 1-14 in FIGS. 6A-B are known from the preparation of the wellbore and the Hunt Mode.

Upon completion of the Hunt Mode and storage of the values, the operator will determine variables of $q_{max}$ and $\overline{P}$ by solving the critical rate equation (Equation 1 of FIG. 6A) and editing $q_{max}$ and $\overline{P}$ until solution is within tolerance of the Operational Gas Injection rate provided by the Hunt Mode as described above. If using the generated production pressure value from FIGS. 9A & 9B in Equations 1-14 of FIGS. 6A and 6B generates a gas injection rate within acceptable tolerance 0.0 to 5.0% of the gas injection rate provided by the Hunt Mode, then the selected values of variables $q_{max}$ and $\overline{P}$ become static values for use in Equations 1-14 of FIGS. 6A and 6B and Equations 1-20 of FIGS. 9A-C in the performance of the flow chart of FIG. 5B. Then user will switch to the Critical Rate Mode and input these determined values for variables $q_{max}$ and $\overline{P}$ of the Vogel IPR Equation. Using the Hagedorn and Brown formulas of FIGS. 9A & 9B, compressor system 10 generates a production pressure value ($P_{wf}$ in FIG. 7, $P_{hf}$ in FIG. 6A, equation 3) for use in Equations 1-14 of FIGS. 6A and 6B.

For the purpose of this example, assume that the resulting gas injection rate is 615 mscfd which is within 1% of 620 mscfd. Therefore, the adjusted variables $q_{max}$ and $\overline{P}$ become static within the calculations performed by compressor system 10. As a result, the Critical Rate Mode continues on a going forward basis using the static values and adjusting the gas injection rate only in response to changes in tubing and casing pressure to inform the process of equations in FIG. 5B and fluid production rate ($Q_o$ oil flow in bbl/d, $Q_g$ gas flow in mscfd, $Q_w$ water flow in bbl/d) as determined by sensors and gauges associated with the wellbore.

Thus, with reference to FIG. 5B, the computer server of compressor system 10 utilizes the static values and measured values directly with a production pressure (bottom hole pressure gauge or indirectly using the surface casing pressure gauge) and fluid production rate ($Q_o$ oil flow in bbl/d, $Q_g$ gas flow in mscfd, $Q_w$ water flow in bbl/d) in Steps 1-3 to generate, through an iterative process, a total gas injection rate. Provided that the resulting gas injection rate is within the predetermined tolerance level, the computer or PLC subtracts the current gas production rate from the calculated gas injection rate (Step 5) to provide the Critical Gas Rate. If the resulting value is greater than zero, then according to Step 6, the computer or PLC of compressor system 10 directs the compressor to provide the Critical Gas Rate injection value to the downhole portion of the wellbore.

Thus, the Critical Rate Mode provides the most efficient production of fluids from the wellbore as the Critical Rate Mode utilizes the gas injection rate determined by the Hunt Mode while compensating for changes in fluid inflow to the wellbore and changes in downstream gas pressures. The compensation allows the Critical Rate Mode to continuously adjust the gas injection rate to ensure that the compressor system 10 efficiently produces all fluids from the well.

Other embodiments of the present invention will be apparent to one skilled in the art. As such, the foregoing description merely enables and describes the general uses and methods of the present invention. Accordingly, the following claims define the true scope of the present invention.

What is claimed is:

1. A method for controlling a compressor system for gas lift operations comprising:

operating the compressor system at an initial gas injection rate sufficient to lift all liquids from the well;

operating the compressor system for a first incremental period of time at a first incremental gas injection rate, wherein said first incremental gas injection rate is either greater than the initial gas injection rate or less than the initial gas injection rate;

continuing to produce liquids from the well during the first incremental period while monitoring production pressure within the well;

determining the average production pressure over the first incremental period;

when the first incremental gas injection rate is greater than the initial gas injection rate, operating the compressor system for a second incremental period of time at a second incremental gas injection rate where the second incremental gas injection rate is greater than the first incremental gas injection rate or when said second incremental gas injection rate is less than the first incremental gas injection rate, operating the compressor system for a second incremental period of time at a second incremental gas injection rate where the second incremental gas injection rate is less than the first incremental gas injection rate;

continuing to produce liquids from the well during the second incremental period while monitoring production pressure within the well;

determining the average production pressure over the second incremental period;

when the first incremental gas injection rate is greater than the initial gas injection rate, operating the compressor system for a third incremental period of time at a third incremental gas injection rate wherein the third incremental gas injection rate is greater than the second incremental gas injection rate or when the first incremental gas injection rate is less than the initial gas injection rate, operating the compressor system for a third incremental period of time at a third incremental gas injection rate wherein the third incremental gas injection rate is less than the second incremental gas injection rate;

continuing to produce liquids from the well during the third incremental period while monitoring production pressure within the well;

determining the average production pressure over the third incremental period;

identifying the incremental gas injection rate which produced the lowest production pressure while unloading all fluids from the well;

setting the identified incremental gas injection rate as an operational gas injection rate for the compressor system and operating the compressor system to produce all fluids from the well; and, wherein each incremental period lasts between about 24 hours and 72 hours.

2. The method of claim 1, further comprising the steps of:

when the first incremental gas injection rate is greater than the initial gas injection rate, after the third incremental period, operating the compressor system for fourth incremental period of time at a fourth incremental gas injection rate wherein the fourth incremental gas injection rate is greater than the third incremental gas injection rate or when the first incremental gas injection rate is less than the initial gas injection rate, after the third incremental period, operating the compressor system for fourth incremental period of time at a fourth incremental gas injection rate wherein the fourth incremental gas injection rate is less than the third incremental gas injection rate;

continuing to produce liquids from the well during the fourth incremental period while monitoring production pressure within the well; and determining the average production pressure over the fourth incremental period.

3. The method of claim 1, further comprising the steps of:

when the first incremental gas injection rate is greater than the initial gas injection rate, after the third incremental period, operating the compressor system for a fourth incremental period of time at a fourth incremental gas injection rate wherein the fourth incremental gas injection rate is greater than the third incremental gas injection rate or when the first incremental gas injection rate is less than the initial gas injection rate, after the third incremental period, operating the compressor system for a fourth incremental period of time at a fourth incremental gas injection rate wherein the fourth incremental gas injection rate is less than the third incremental gas injection rate;

continuing to produce liquids from the well during the fourth incremental period while monitoring production pressure within the well;

determining the average production pressure over the fourth incremental period;

when the first incremental gas injection rate is greater than the initial gas injection rate and after the fourth incremental period, operating the compressor system for a fifth incremental period of time at a fifth incremental gas injection rate wherein the fifth incremental gas injection rate is greater than the fourth incremental gas injection rate or when the first incremental gas injection rate is less than the initial gas injection rate and after the fourth incremental period, operating the compressor system for a fifth incremental period of time at a fifth incremental gas injection rate wherein the fifth incremental gas injection rate is less than the fourth incremental gas injection rate;

continuing to produce liquids from the well during the fifth incremental period while monitoring production pressure within the well; and determining the average production pressure over the fifth incremental period.

4. The method of claim 1, further comprising:

when the first incremental gas injection rate is greater than the initial gas injection rate and after the third incremental period, operating the compressor system for a fourth incremental period of time at a fourth incremental gas injection rate wherein the fourth incremental gas injection rate is greater than the third incremental gas injection rate or when the first incremental gas injection rate is less than the initial gas injection rate and after the third incremental period, operating the compressor system for a fourth incremental period of time at a fourth incremental gas injection rate wherein the fourth incremental gas injection rate is less than the third incremental gas injection rate;

continuing to produce liquids from the well during the fourth incremental period while monitoring production pressure within the well;

determining the average production pressure over the fourth incremental period;

when the first incremental gas injection rate is greater than the initial gas injection rate and after the fourth incremental period, operating the compressor system for a fifth incremental period of time at a fifth incremental gas injection rate wherein the fifth incremental gas injection rate is greater than the fourth incremental gas injection rate or when the first incremental gas injection rate is greater than the initial gas injection rate and after the fourth incremental period, operating the compressor system for a fifth incremental period of time at a fifth incremental gas injection rate wherein the fifth incremental gas injection rate is less than the fourth incremental gas injection rate;

continuing to produce liquids from the well during the fifth incremental period while monitoring production pressure within the well;

determining the average production pressure over the fifth incremental period;

when the first incremental gas injection rate is greater than the initial gas injection rate and after the fifth incremental period, operating the compressor system for a sixth incremental period of time at a sixth incremental gas injection rate wherein the sixth incremental gas injection rate is greater than the fifth incremental gas injection rate or when the first incremental gas injection rate is less than the initial gas injection rate and after the fifth incremental period, operating the compressor system for a sixth incremental period of time at a sixth incremental gas injection rate wherein the sixth incremental gas injection rate is less than the fifth incremental gas injection rate;

continuing to produce liquids from the well during the sixth incremental period while monitoring production pressure within the well; and determining the average production pressure over the sixth incremental period.

5. The method of claim 1, wherein the increase or decrease in gas injection rate during the first, second, and third incremental periods is about 20 mscfd to about 80 mscfd.

6. The method of claim 1, further comprising the step of recording well conditions of fluid flow rates, gas production rate and gas injection rate which produced the lowest average production pressure during the incremental periods.

7. The method of claim 1, wherein the incremental period lasts between about 36 hours and about 60 hours.

8. The method of claim 1, further comprising the steps of:

estimating a maximum flow rate of fluids out of the well ($q_{max}$) and an average reservoir pressure ($\overline{P}$) at the maximum flow rate of fluids out of the well;

measuring the production pressure using a bottom hole sensor or measuring the surface casing pressure using a surface sensor and calculating the production pressure;

calculate the total gas injection rate needed to unload all fluids from the wellbore using the measured or calculated production pressure and the estimated values of $q_{max}$ and $\overline{P}$;

comparing the calculated total gas injection rate to the gas injection rate which produced the lowest production pressure while unloading all fluids from the well, if the calculated total gas injection rate is within the tolerance range of the gas injection rate which produced the lowest production pressure while unloading all fluids from the well, then set the values of $q_{max}$ and $\overline{P}$ as static values for the calculation of the minimum gas injection rate necessary to unload the well of all liquids;

calculate the minimum gas injection rate necessary to unload the well of all liquids; and directing the compressor system to operate at the calculated minimum gas injection rate.

9. The method of claim 8, wherein the step of calculating the minimum gas injection rate necessary to unload the well of all liquids, further comprises the steps of:

monitoring fluid flow rates of water, gas, and oil out of the well;

monitoring bottom hole pressure or calculating bottom hole pressure by using a monitored surface casing pressure;

calculating the total gas flow rate needed to carry all fluids out of the well;

subtracting the flow rate of gas out of the well from the calculated total gas flow rate needed to carry all fluids out of the well to provide the minimum gas injection rate necessary to unload the well of all liquids; and operating the compressor system at the minimum gas injection rate necessary to unload the well of all liquids.

10. The method of claim 9, further comprising the step of comparing the critical gas injection rate to the flow rate of gas out of the well and ceasing compressor system operation when the critical gas injection rate is less than the flow rate of gas out of the well.

11. The method of claim 1, wherein the step of determining the average production pressure during the first incremental period takes place over the last 85% to 95% of the first incremental period, wherein the step of determining the average production pressure during the second incremental period takes place over the last 85% to 95% of the second incremental period, and wherein the step of determining the average production pressure during the third incremental period takes place over the last 85% to 95% of the third incremental period.

12. A method for controlling a compressor system for gas lift operations comprising:

operating the compressor system at an initial gas injection rate sufficient to lift all liquids from the well;

operating the compressor system for a first incremental period of time at a first incremental gas injection rate, wherein said first incremental gas injection rate is either greater than the initial gas injection rate or less than the initial gas injection rate;

continuing to produce liquids from the well during the first incremental period while monitoring production pressure within the well;

determining the average production pressure over the first incremental period;

when the first incremental gas injection rate is greater than the initial gas injection rate, operating the compressor system for a second incremental period of time at a second incremental gas injection rate wherein the second incremental gas injection rate is less than the first incremental gas injection rate or when the first incremental gas injection rate is less than the initial gas injection rate, operating the compressor system for a second incremental period of time at a second incremental gas injection rate wherein said second incremental gas injection rate is greater than the first incremental gas injection rate;

continuing to produce liquids from the well during the second incremental period while monitoring production pressure within the well;

determining the average production pressure over the second incremental period;

when the first incremental gas injection rate is greater than the initial gas injection rate, operating the compressor system for a third incremental period of time at a third incremental gas injection rate wherein the third incremental gas injection rate is less than the second incremental gas injection rate or when the first incremental gas injection rate is less than the initial gas injection rate, operating the compressor system for a third incremental period of time at a third incremental gas injection rate wherein said third incremental gas injection rate is greater than the second incremental gas injection rate;

continuing to produce liquids from the well during the third incremental period while monitoring production pressure within the well;

determining the average production pressure over the third incremental period;

identifying the incremental gas injection rate which produced the lowest production pressure while unloading all fluids from the well; and setting the identified incremental gas injection rate as an operational gas injection rate for the compressor system and operating the compressor system to produce all fluids from the well; and, wherein each incremental period lasts between about 24 hours and 72 hours.

13. The method of claim 12, further comprising the steps of:

when the first incremental gas injection rate is greater than the initial gas injection rate and after the third incremental period, operating the compressor system for a fourth incremental period of time at a fourth incremental gas injection rate wherein the fourth incremental gas injection rate is less than the third incremental gas injection rate or when the first incremental gas injection rate is less than the initial gas injection rate operating the compressor system for a fourth incremental period of time at a fourth incremental gas injection rate wherein the fourth incremental gas injection rate is greater than the third incremental gas injection rate;

continuing to produce liquids from the well during the fourth incremental period while monitoring production pressure within the well; and determining the average production pressure over the fourth incremental period.

14. The method of claim 12, further comprising the steps of:

when the first incremental gas injection rate is greater than the initial gas injection rate and after the third incremental period, operating the compressor system for a fourth incremental period of time at a fourth incremental gas injection rate wherein the fourth incremental gas injection rate is less than the third incremental gas injection rate or when the first incremental gas injection rate is less than the initial gas injection rate operating the compressor system for a fourth incremental period of time at a fourth incremental gas injection rate wherein the fourth incremental gas injection rate is greater than the third incremental gas injection rate;

continuing to produce liquids from the well during the fourth incremental period while monitoring production pressure within the well;

determining the average production pressure over the fourth incremental period;

when the first incremental gas injection rate is greater than the initial gas injection rate and after the fourth incremental period, operating the compressor system for a fifth incremental period of time at a fifth incremental gas injection rate wherein the fifth incremental gas injection rate is less than the fourth incremental gas injection rate when the first incremental gas injection rate is less than the initial gas injection rate and after the fourth incremental period, operating the compressor system for a fifth incremental period of time at a fifth incremental gas injection rate wherein the fifth incremental gas injection rate is greater than the fourth incremental gas injection rate;

continuing to produce liquids from the well during the fifth incremental period while monitoring production pressure within the well; and determining the average production pressure over the fifth incremental period.

15. The method of claim 12, further comprising:

when the first incremental gas injection rate is greater than the initial gas injection rate and after the third incremental period, operating the compressor system for a fourth incremental period of time at a fourth incremental gas injection rate wherein the fourth incremental gas injection rate is less than the third incremental gas injection rate or when the first incremental gas injection rate is less than the initial gas injection rate operating the compressor system for a fourth incremental period of time at a fourth incremental gas injection rate wherein the fourth incremental gas injection rate is greater than the third incremental gas injection rate;

continuing to produce liquids from the well during the fourth incremental period while monitoring production pressure within the well;

determining the average production pressure over the fourth incremental period;

when the first incremental gas injection rate is greater than the initial gas injection rate and after the fourth incremental period, operating the compressor system for a fifth incremental period of time at a fifth incremental gas injection rate wherein the fifth incremental gas injection rate is less than the fourth incremental gas injection rate when the first incremental gas injection rate is less than the initial gas injection rate and after the fourth incremental period, operating the compressor system for a fifth incremental period of time at a fifth incremental gas injection rate wherein the fifth incremental gas injection rate is greater than the fourth incremental gas injection rate;

continuing to produce liquids from the well during the fifth incremental period while monitoring production pressure within the well;

determining the average production pressure over the fifth incremental period;

when the first incremental gas injection rate is greater than the initial gas injection rate and after the fifth incremental period, operating the compressor system for a sixth incremental period of time at a sixth incremental gas injection rate wherein the sixth incremental gas injection rate is less than the fifth incremental gas injection rate when the first incremental gas injection rate is less than the initial gas injection rate and after the fifth incremental period, operating the compressor system for a sixth incremental period of time at a sixth incremental gas injection rate wherein the sixth incremental gas injection rate is greater than the fifth incremental gas injection rate;

continuing to produce liquids from the well during the sixth incremental period while monitoring production pressure within the well; and determining the average production pressure over the sixth incremental period.

16. The method of claim 12, wherein the increase or decrease in gas injection rate during the first, second, and third incremental periods is about 20 mscfd to about 80 mscfd.

17. The method of claim 12, further comprising the step of recording well conditions of fluid flow rates, gas production rate and gas injection rate which produced the lowest average production pressure during the incremental periods.

18. The method of claim 12, wherein the incremental period lasts between about 36 hours and about 60 hours.

19. The method of claim 12, further comprising the steps of:

estimating a maximum flow rate of fluids out of the well ($q_{max}$) and an average reservoir pressure ($\overline{P}$) at the maximum flow rate of fluids out of the well;

measuring the production pressure using a bottom hole sensor or measuring the surface casing pressure using a surface sensor and calculating the production pressure;

calculate the total gas injection rate needed to unload all fluids from the wellbore using the measured or calculated production pressure and the estimated values of $q_{max}$ and $\overline{P}$;

comparing the calculated total gas injection rate to the gas injection rate which produced the lowest production pressure while unloading all fluids from the well, if the calculated total gas injection rate is within the tolerance range of the gas injection rate which produced the lowest production pressure while unloading all fluids from the well, then set the values of $q_{max}$ and $\overline{P}$ as static values for the calculation of the minimum gas injection rate necessary to unload the well of all liquids;

calculate the minimum gas injection rate necessary to unload the well of all liquids; and directing the compressor system to operate at the calculated minimum gas injection rate.

20. The method of claim 19, wherein the step of calculating the minimum gas injection rate necessary to unload the well of all liquids, further comprises the steps of:

monitoring fluid flow rates of water, gas, and oil out of the well;

monitoring bottom hole pressure or calculating bottom hole pressure by using a monitored surface casing pressure;

calculating the total gas flow rate needed to carry all fluids out of the well;

subtracting the flow rate of gas out of the well from the calculated total gas flow rate needed to carry all fluids out of the well to provide the minimum gas injection rate necessary to unload the well of all liquids; and operating the compressor system at the minimum gas injection rate necessary to unload the well of all liquids.

21. The method of claim 20, further comprising the step of comparing the critical gas injection rate to the flow rate of gas out of the well and ceasing compressor system operation when the critical gas injection rate is less than the flow rate of gas out of the well.

22. The method of claim 12, wherein the step of determining the average production pressure during the first incremental period takes place over the last 85% to 95% of the first incremental period, wherein the step of determining the average production pressure during the second incremental period takes place over the last 85% to 95% of the second incremental period, and wherein the step of determining the average production pressure during the third incremental period takes place over the last 85% to 95% of the third incremental period.

* * * * *